US009836000B2

(12) United States Patent
Takemoto

(10) Patent No.: US 9,836,000 B2
(45) Date of Patent: Dec. 5, 2017

(54) FIXING DEVICE AND IMAGE FORMING APPARATUS

(71) Applicant: KYOCERA Document Solutions Inc., Osaka (JP)

(72) Inventor: Mitsutoshi Takemoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/230,747

(22) Filed: Aug. 8, 2016

(65) Prior Publication Data

US 2017/0060063 A1 Mar. 2, 2017

(30) Foreign Application Priority Data

Aug. 26, 2015 (JP) ..... 2015-166790

(51) Int. Cl.

| | |
|---|---|
| ***G03G 21/16*** | (2006.01) |
| ***G03G 15/20*** | (2006.01) |
| ***G03G 15/00*** | (2006.01) |
| *G03G 15/23* | (2006.01) |

(52) U.S. Cl.

CPC ..... *G03G 15/5029* (2013.01); *G03G 15/2017* (2013.01); *G03G 15/70* (2013.01); *G03G 21/1638* (2013.01); *G03G 21/1685* (2013.01); *G03G 21/1695* (2013.01); *G03G 15/234* (2013.01); *G03G 2215/00544* (2013.01)

(58) Field of Classification Search

CPC ..... G03G 21/1638; G03G 21/1685; G03G 21/1695

See application file for complete search history.

(56) References Cited

U.S. PATENT DOCUMENTS

2004/0184823 A1* 9/2004 Fujii ..... G03G 15/6538 399/9

FOREIGN PATENT DOCUMENTS

| | | | | |
|---|---|---|---|---|
| JP | 08083020 A | * | 3/1996 | |
| JP | 2005-301165 A | | 10/2005 | |
| JP | 2007298740 A | * | 11/2007 | ..... G03G 15/234 |

OTHER PUBLICATIONS

JP_2007298740_A_T Machine Translation Japan, Uehara, 2007.*

* cited by examiner

*Primary Examiner* — Victor Verbitsky

(74) *Attorney, Agent, or Firm* — Studebaker & Brackett PC

(57) ABSTRACT

A fixing device includes a fixing member, a pressuring member, a fixing device main body, a guide member and a detecting mechanism. The guide member is rotatable between a closing position where the guide member covers a sheet conveying path and an opening position where the guide member exposes the sheet conveying path. The detecting mechanism includes a sensor and an actuator. The sensor includes a light emitting part and a light receiving part. The actuator is swingable between a non-blocking position where the actuator does not block a light and a blocking position where the actuator blocks the light. When the actuator rotates integrally with the guide member according to a rotation of the guide member between the closing position and the opening position, the actuator passes between the light emitting part and the light receiving part.

8 Claims, 8 Drawing Sheets

FIXING DEVICE AND IMAGE FORMING APPARATUS

INCORPORATION BY REFERENCE

This application is based on and claims the benefit of priority from Japanese patent application No. 2015-166790 filed on Aug. 26, 2015, which is incorporated by reference in its entirety.

BACKGROUND

The present disclosure relates to a fixing device configured to fix a toner image on a sheet and an image forming apparatus including the fixing device.

Conventionally, an electrographic image forming apparatus, such as a copying machine or a printer, includes a fixing device configured to fix a toner image on a sheet.

The fixing device commonly includes a detecting mechanism configured to detect the sheet so as to confirm passing of the sheet. For example, the detecting mechanism includes a sensor including a light emitting part and a light receiving part and an actuator configured to be swingable between a position where the actuator does not block a light directed from the light emitting part toward the light receiving part and another position where the actuator blocks the light directed from the light emitting part toward the light receiving part.

Additionally, the fixing device commonly includes a guide member configured to be rotatable between a position where the guide member covers a sheet conveying path and another position where the guide member exposes the sheet conveying path so as to facilitate JAM processing.

SUMMARY

In accordance with an embodiment of the present disclosure, a fixing device includes a fixing member, a pressuring member, a fixing device main body, a guide member and a detecting mechanism. The fixing member is configured to be rotatable. The pressuring member is configured to be rotatable and to come into pressure contact with the fixing member so as to form a fixing nip. The fixing device main body is configured to rotatably support the fixing member. The guide member is supported by the fixing device main body so as to be rotatable between a closing position where the guide member covers a sheet conveying path formed in the fixing device main body and an opening position where the guide member exposes the sheet conveying path formed in the fixing device main body. The detecting mechanism is configured to detect a sheet. The detecting mechanism includes a sensor and an actuator. The sensor includes a light emitting part and a light receiving part. The actuator is supported by the guide member so as to be swingable between a non-blocking position where the actuator does not block a light directed from the light emitting part toward the light receiving part and a blocking position where the actuator blocks the light directed from the light emitting part toward the light receiving part. The rotation center of the guide member is arranged at a different position from a swing center of the actuator. When the actuator rotates integrally with the guide member according to a rotation of the guide member between the closing position and the opening position, the actuator passes between the light emitting part and the light receiving part.

In accordance with an embodiment of the present disclosure, an image forming apparatus includes the fixing device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to drawings, a structure of a color printer 1 (an image forming apparatus) will be described. Hereinafter, a near side in FIG. 1 will be set as a front side of the color printer 1. Arrows Fr, Rr, L, R, U and Lo optionally added to each drawing indicate a front side, a rear side, a left side, a right side, an upper side and a lower side of the color printer 1, respectively.

Figure 1:
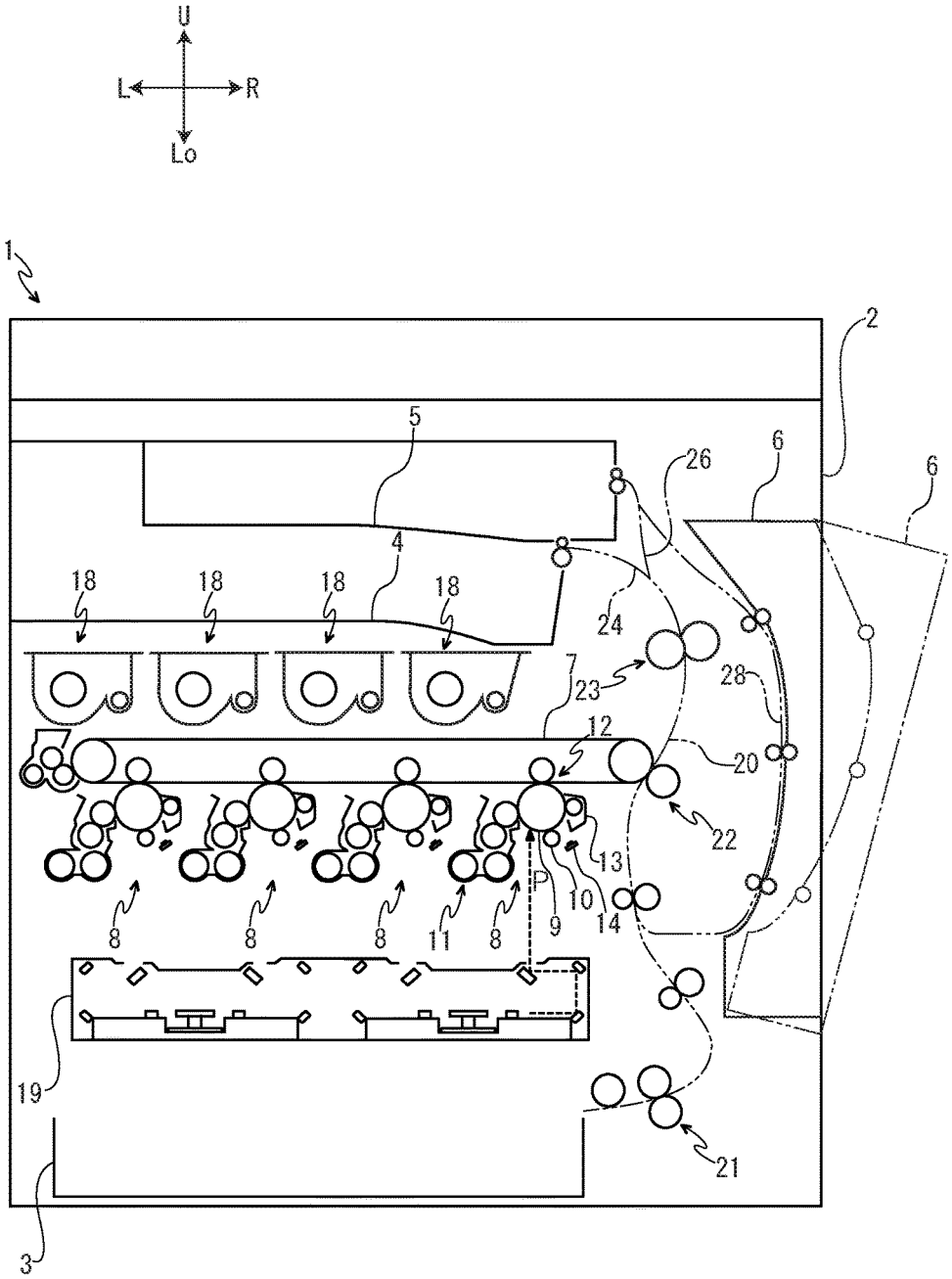
FIG. 1 is a schematic view showing an outline of a color printer according to an embodiment of the present disclosure.

As shown in FIG.1, the color printer 1 includes a box-formed printer main body 2. In a lower part of the printer main body 2, a sheet feeding cartridge 3 to store a sheet is arranged. In an upper part of the printer main body 2, a first sheet ejecting tray 4 is arranged, and above the first sheet ejecting tray 4, a second sheet ejecting tray 5 is arranged. In a right end part of the printer main body 2, a cover 6 configured to be openable and closable is arranged.

In the printer main body 2, an intermediate transferring belt 7 (an image carrier) is bridged over a plurality of rollers. Below the intermediate transferring belt 7, four image forming parts 8 are arranged for respective colors of toners (for example, four colors of magenta, cyan, yellow, black) along a lower part of the intermediate transferring belt 7. In each image forming part 8, a photosensitive drum 9 is rotatably arranged. Around the photosensitive drum 9, a charger 10, a development device 11, a primary transferring part 12, a cleaning device 13 and a static eliminator 14 are arranged in order of a primary transferring process. Above the development device 11, four containers 18 are arranged. In each container 18, the toner with the color corresponding to each image forming part 8 is contained. Below the four image forming parts 8, an exposure device 19 is arranged.

At a right side part of the printer main body 2, a sheet conveying path 20 (hereinafter, simply called as a "conveying path 20") is arranged. At an upstream end of the conveying path 20, a sheet feeding part 21 is arranged. At an intermediate stream part of the conveying path 20, a secondary transferring part 22 is arranged at a right end side of the intermediate transferring belt 7. At a downstream part of the conveying path 20, a fixing device 23 is arranged.

The conveying path 20 branches off, at a part closer to a downstream side than the fixing device 23, into a first branched path 24 as a lower side branched path and a second branched path 26 as an upper side branched path. The second branched path 26 is connected with a portion of the conveying path 20 via a duplex conveying path 28 arranged at a right side of the conveying path 20, the portion being closer to an upstream side than the secondary transferring part 22.

Next, printing operation of the color printer 1 will be described.

When power is supplied to the color printer 1, various parameters are initialized, and initial determination, such as temperature determination of the fixing device 23, is carried out. Subsequently, when image data is inputted and a printing start is directed from a computer or the like connected with the color printer 1, image forming operation is carried out as follows.

First, the surface of the photosensitive drum 9 is electrically charged by the charger 10. Then, exposure corresponding to the image data is carried out on the photosensitive drum 9 by a laser (refer to an arrow P) from the exposure device 19, thereby forming an electrostatic latent image on the surface of the photosensitive drum 9. Next, by the toner supplied from each container 18, the electrostatic latent image is developed by the development device 11 to a toner image having a corresponding color. The toner image is primarily transferred on the surface of the intermediate transferring belt 7 in the primary transferring part 12. The above-mentioned operation is repeated in order by each image forming part 8, thereby forming the toner image with full color on the intermediate transferring belt 7. Incidentally, the toner and electric charge remained on the photosensitive drum 9 are eliminated by the cleaning device 13 and the static eliminator 14.

On the other hand, a sheet fed from the sheet feeding cartridge 3 by the sheet feeding part 21 is conveyed to the secondary transferring part 22 in a suitable timing for the above-mentioned image forming operation. Then, in the secondary transferring part 22, the toner image with the full color on the intermediate transferring belt 7 is secondarily transferred to the sheet. The sheet with the secondarily transferred toner image is conveyed to a downstream side on the conveying path 20 to enter the fixing device 23, and then, the toner image is fixed on the sheet in the fixing device 23. The sheet with the fixed toner image enters either one of the first branched path 24 or the second branched path 26. The sheet entering the first branched path 24 is ejected to the first sheet ejecting tray 4. The sheet entering the second branched path 26 is ejected to the second sheet ejecting tray 5 or conveyed to the duplex conveying path 28 for duplex printing.

Figure 4:
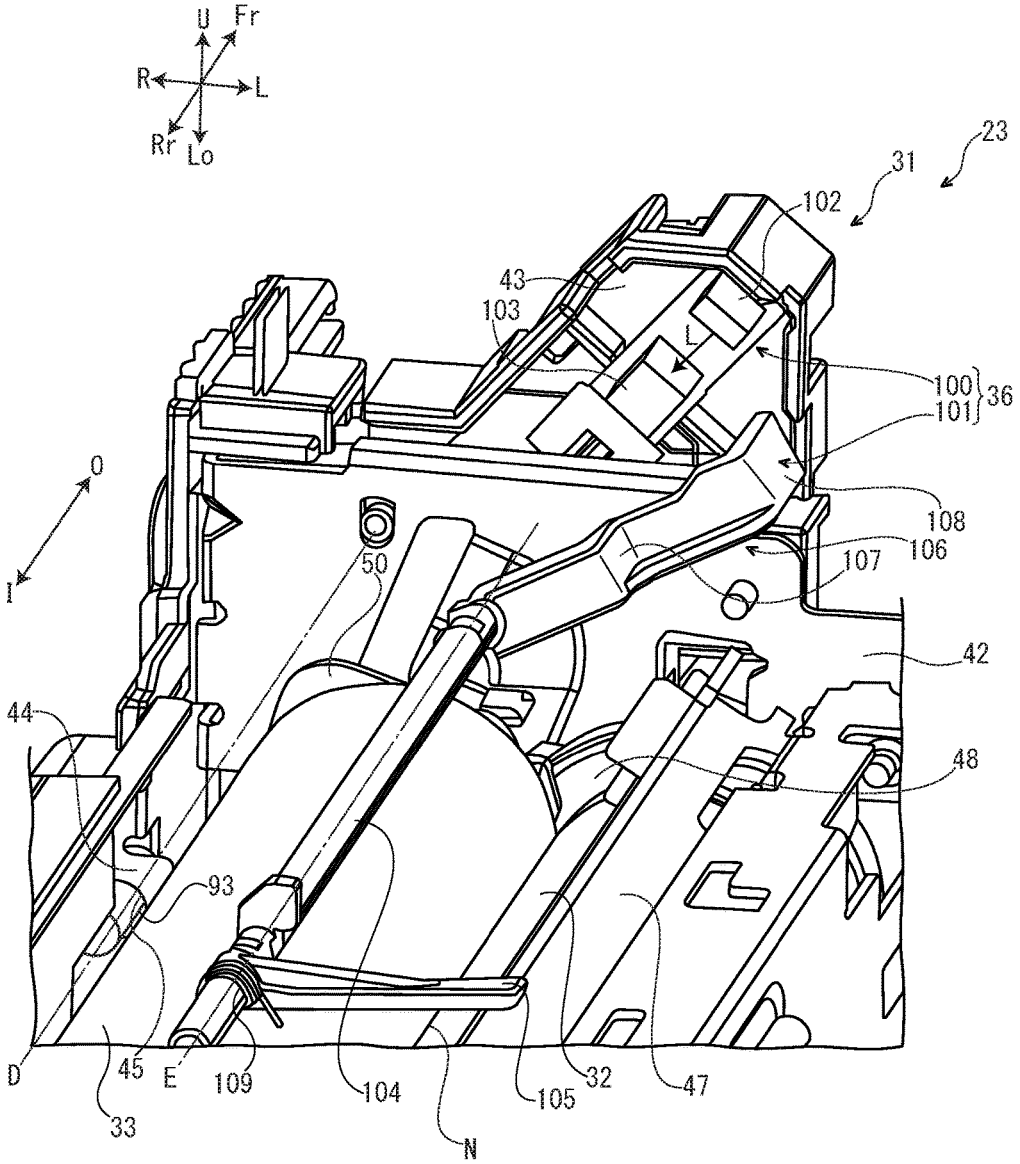
FIG. 4 is a perspective view showing a state where an actuator is in a non-blocking position, in the fixing device according to the embodiment of the present disclosure.
Figure 5:
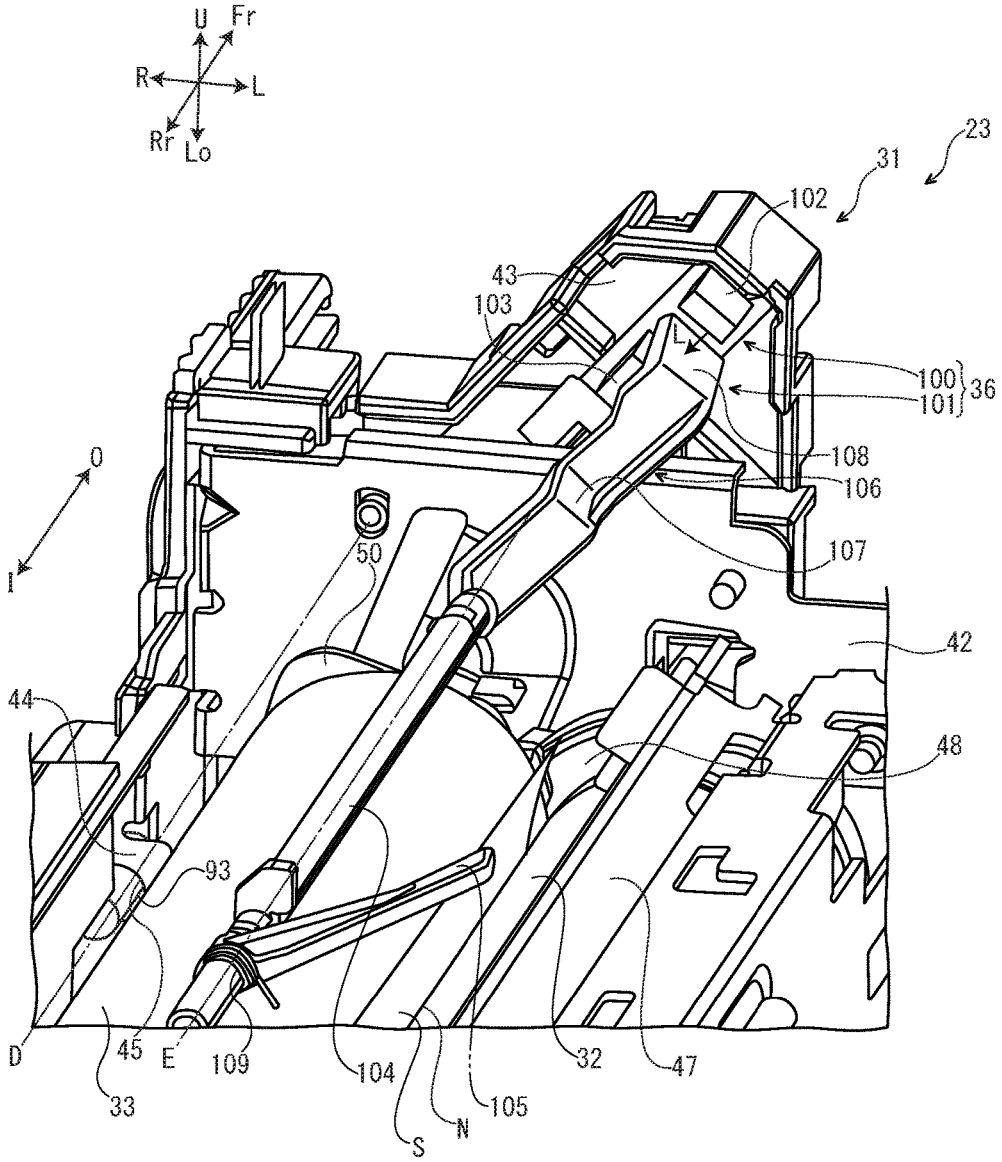
FIG. 5 is a perspective view showing a state where the actuator is in a blocking position, in the fixing device according to the embodiment of the present disclosure.

Next, the fixing device 23 will be described in detail. An arrow Y assigned in FIG. 2 indicates a sheet conveying direction. An arrow I optionally assigned in each drawing indicates an inside of a front and rear direction, and an arrow O optionally assigned in each drawing indicates an outside in the front and rear direction. Incidentally, FIGS. 4 and 5 are perspective views seen from a back side, and therefore a left and right relationship in these drawings is reversed from an actual left and right relationship.

Figure 2:
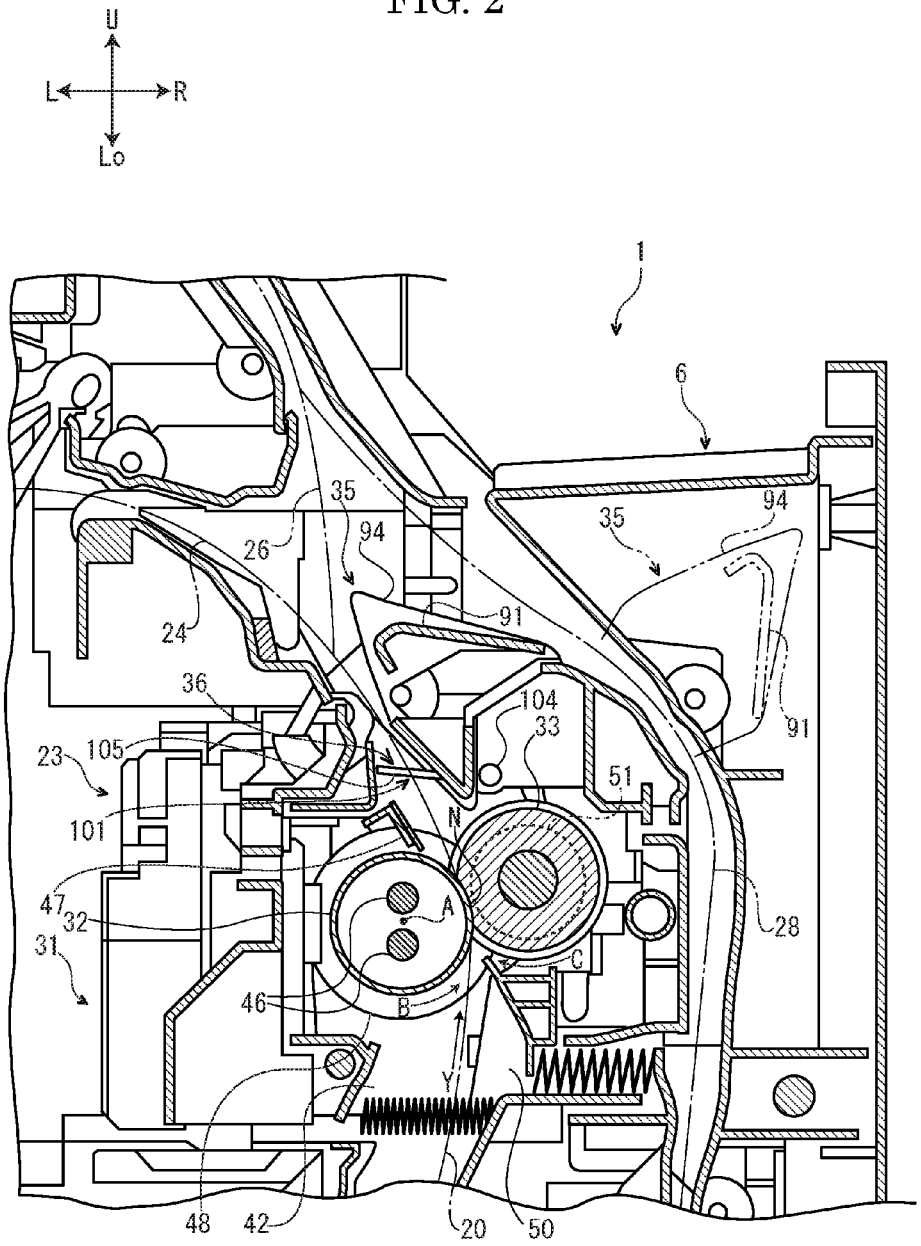
FIG. 2 is a sectional view showing a fixing device and its periphery, in the color printer according to the embodiment of the present disclosure.

As shown in FIG. 2, a right face (outer face) of the fixing device 23 is covered by the above-mentioned cover 6. The fixing device 23 includes a fixing device main body 31, a heat roller 32 (fixing member) accommodated at a left side part of the fixing device main body 31, a pressuring roller 33 (pressuring member) accommodated at a right side part of the fixing device main body 31, a guide member 35 covering an upper side of the fixing device main body 31, and a detecting mechanism 36 accommodated at an upper part of the fixing device main body 31.

Figure 3:
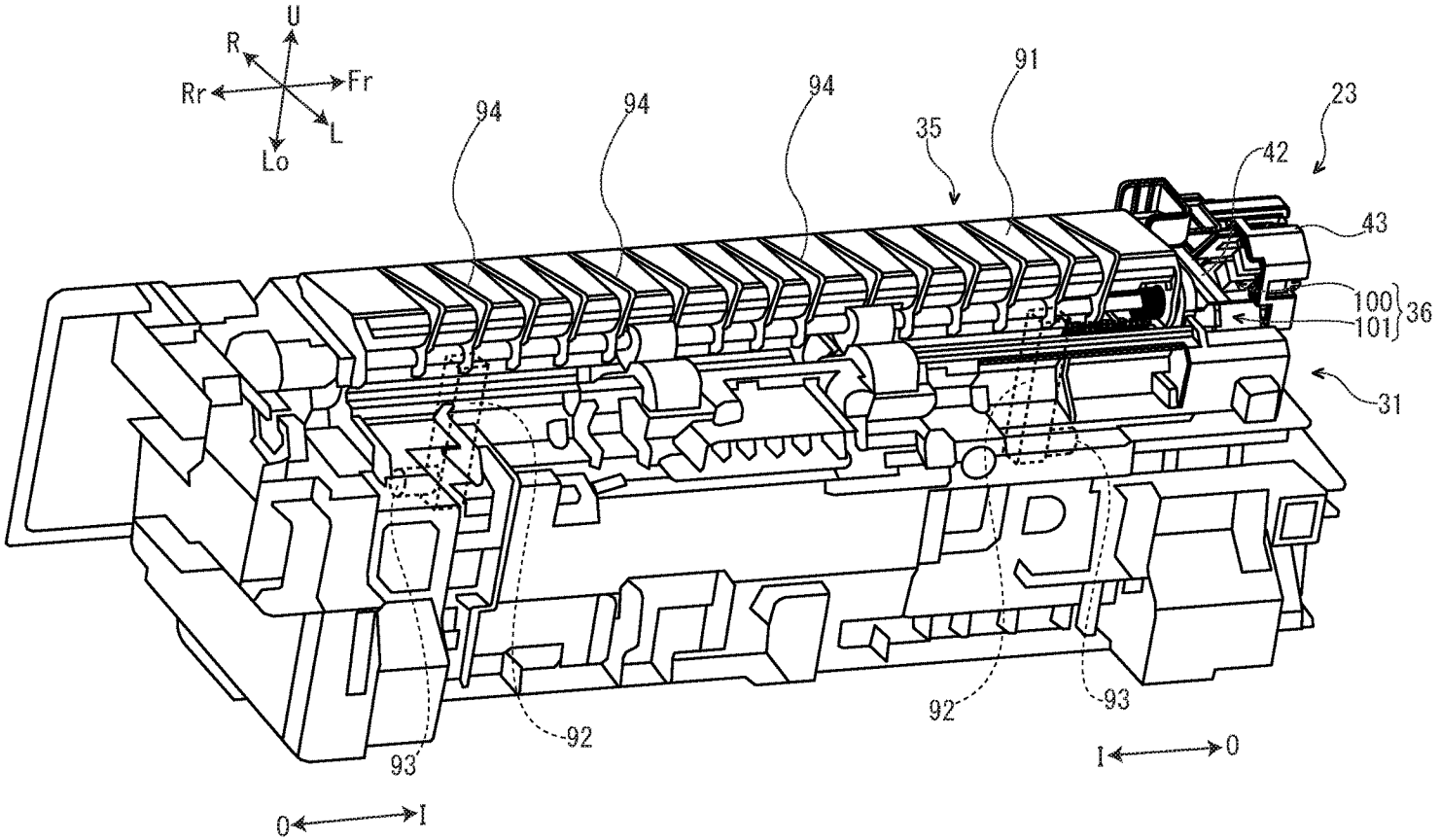
FIG. 3 is a perspective view showing the fixing device according to the embodiment of the present disclosure.

As shown in FIG. 3, the fixing device main body 31 is formed in a box shape elongated in the front and rear direction. As shown in FIGS. 4 and 5, at a front part and a rear part of the fixing device main body 31, side plates 42 (only the front side plate 42 is shown in FIGS. 4 and 5) are arranged. Each side plate 42 is roughly vertically arranged with respect to the front and rear direction. Each side plate 42 is arranged at the outside of the heat roller 32 and the pressuring roller 33 in the front and rear direction. To the front side plate 42, an attachment member 43 is fixed from a front side (the outside in the front and rear direction). An upper part of the attachment member 43 protrudes closer to an upper side than an upper end part of the front side plate 42.

At a right side part of the fixing device main body 31 (a left side part in FIGS. 4 and 5), and at the inside in the front and rear direction of each side plate 42, tongue pieces 44 are arranged. Each tongue piece 44 is roughly vertically arranged with respect to the front and rear direction. Each tongue piece 44 is provided with an axial hole 45.

As shown in FIG. 2, the heat roller 32 is formed in a cylindrical shape. The heat roller 32 includes a core material which has a cylindrical shape and is made of metal, such as aluminum or iron, and a release layer which covers this core material and is made of a fluorine resin, such as PFA.

Inside the heat roller 32, a pair of upper and lower heaters 46 are accommodated, and each heater 46 heats the heat roller 32. Each heater 46 is composed of a halogen heater or a ceramic heater, for example. At an upper side of the heat roller 32 (a downstream side in the sheet conveying direction), a separating member 47 is arranged, and this separating member 47 separates the sheet from a surface of the heat roller 32.

Both front and rear end parts of the heat roller 32 are attached to the side plates 42 of the fixing device main body 31, respectively, via a first bearing 48. Thus, the heat roller 32 is rotatably supported by the fixing device main body 31. The heat roller 32 is rotatable around a rotation axis A extending in the front and rear direction. That is, in the present embodiment, the front and rear direction is a direction of the rotation axis of the heat roller 32.

The pressuring roller 33 is formed in a columnar shape. The pressuring roller 33 includes a core material which has a columnar shape and is made of metal, such as aluminum or iron, an elastic layer which is provided around this core material and is made of a silicon rubber and the like, and a release layer which covers this elastic layer and is made of a fluorine resin, such as PFA. The pressuring roller 33 comes into pressure contact with the heat roller 32 so as to form a fixing nip N between the heat roller 32 and the pressuring roller 33.

At a front end side and a rear end side of the pressuring roller 33, swing members 50 are respectively arranged. Each swing member 50 is swingably supported by the fixing device main body 31. The pressuring roller 33 is rotatably supported by each swing member 50 via a second bearing 51.

As shown in FIG. 3, the guide member 35 is formed in a shape elongated in the front and rear direction. The guide member 35 includes a main body part 91 elongated along the front and rear direction, a pair of arm parts 92 protruding downward from both front and rear end parts of the main body part 91, and bosses 93 protruding from lower end parts of the arm parts 92 toward the outside in the front and rear direction.

In an outer face of the main body part 91 of the guide member 35, multiple conveying ribs 94 are arranged in a row at intervals in the front and rear direction. As shown in FIG. 2, a left side part of each conveying rib 94 faces the conveying path 20 and the second branched path 26, and an upper part of each conveying rib 94 faces the duplex conveying path 28. Thus, each conveying rib 94 composes a part of the conveying path 20, the second branched path 26 and the duplex conveying path 28.

As shown in FIGS. 4 and 5, each boss 93 of the guide member 35 engages with an axial hole 45 of each tongue piece 44 of the fixing device main body 31. Thus, the guide member 35 is supported by the fixing device main body 31 so as to be rotatable around an axis line D passing each center of the axial hole 45 of each tongue piece 44 and each boss 93. Incidentally, in FIGS. 4 and 5, only the front boss 93 of the guide member 35 is shown, and other portions of the guide member 35 are omitted.

As shown in FIG. 2, the guide member 35 is rotatably arranged between a closing position (see a solid line in FIG. 2) where the guide member 35 covers the conveying path 20 formed in the fixing device main body 31, and an opening position (see a two-dot chain line in FIG. 2) where the guide member 35 exposes the conveying path 20 formed in the fixing device main body 31.

As shown in FIGS. 4 and 5, the detecting mechanism 36 includes a sensor 100, and an actuator 101 arranged at a lower rear side of the sensor 100.

The sensor 100 of the detecting mechanism 36 is attached to a rear face (a face at the inside in the front and rear direction) of the attachment member 43. Thus, the sensor 100 is held by the front side plate 42 of the fixing device main body 31 via the attachment member 43.

The sensor 100 of the detecting mechanism 36 includes a light emitting part 102, and a light receiving part 103 arranged at a lower right side of the light emitting part 102 (a lower left side in FIGS. 4 and 5), and the light receiving part 103 receives light L from the light emitting part 102. That is, the sensor 100 according to the present embodiment is a so-called "PI sensor (Photo Interrupter Sensor)".

The actuator 101 of the detecting mechanism 36 includes a shaft 104 elongated along the front and rear direction, a pressed piece 105 protruding from a rear part (a part at the inside in the front and rear direction) of the shaft 104 to an outer diameter side, and a detected piece 106 protruding from a front end part (an end part at the outside in the front and rear direction) of the shaft 104 to the outer diameter side.

The shaft 104 of the actuator 101 of the detecting mechanism 36 is rotatably attached to the guide member 35 (not shown except for the front boss 93 in FIGS. 4 and 5). Thus, the actuator 101 is supported by the guide member 35 so as to be swingable around an axis line E passing a center of the shaft 104. The axis line E (a swing center of the actuator 101) is arranged at a different position from that of the axis line D (a rotation center of the guide member 35).

The pressed piece 105 of the actuator 101 of the detecting mechanism 36 is formed in a straight bar shape. The pressed piece 105 is arranged in a minimum passing region (a region through which the sheet with a minimum size passes). As shown in FIG. 2, at an upper side (a downstream side in the sheet conveying direction) of the fixing nip N, the pressed piece 105 protrudes into the conveying path 20.

As shown in FIGS. 4 and 5, a longitudinal first end part (base end part) of the detected piece 106 of the actuator 101 of the detecting mechanism 36 is fixed to the shaft 104. A longitudinal roughly center part of the detected piece 106 is provided with a step part 107. A longitudinal second end part (distal end part) of the detected piece 106 is provided with a bent part 108 bent toward the front side (the outside in the front and rear direction). The detected piece 106 is arranged outside a maximum passing region (a region in which the sheet with a maximum size passes).

The actuator 101 of the detecting mechanism 36 is swingably arranged between a non-blocking position (see FIG. 4) where the bent part 108 of the detected piece 106 does not block the light L directed from the light emitting part 102 of the sensor 100 toward the light receiving part 103, and a blocking position (see FIG. 5) where the bent part 108 of the detected piece 106 blocks the light L directed from the light emitting part 102 of the sensor 100 toward the light receiving part 103. The actuator 101 is held at the non-blocking position (see FIG. 4) by biasing force of a torsion coil spring 109 wound around an outer circumference of the shaft 104.

Figure 6:
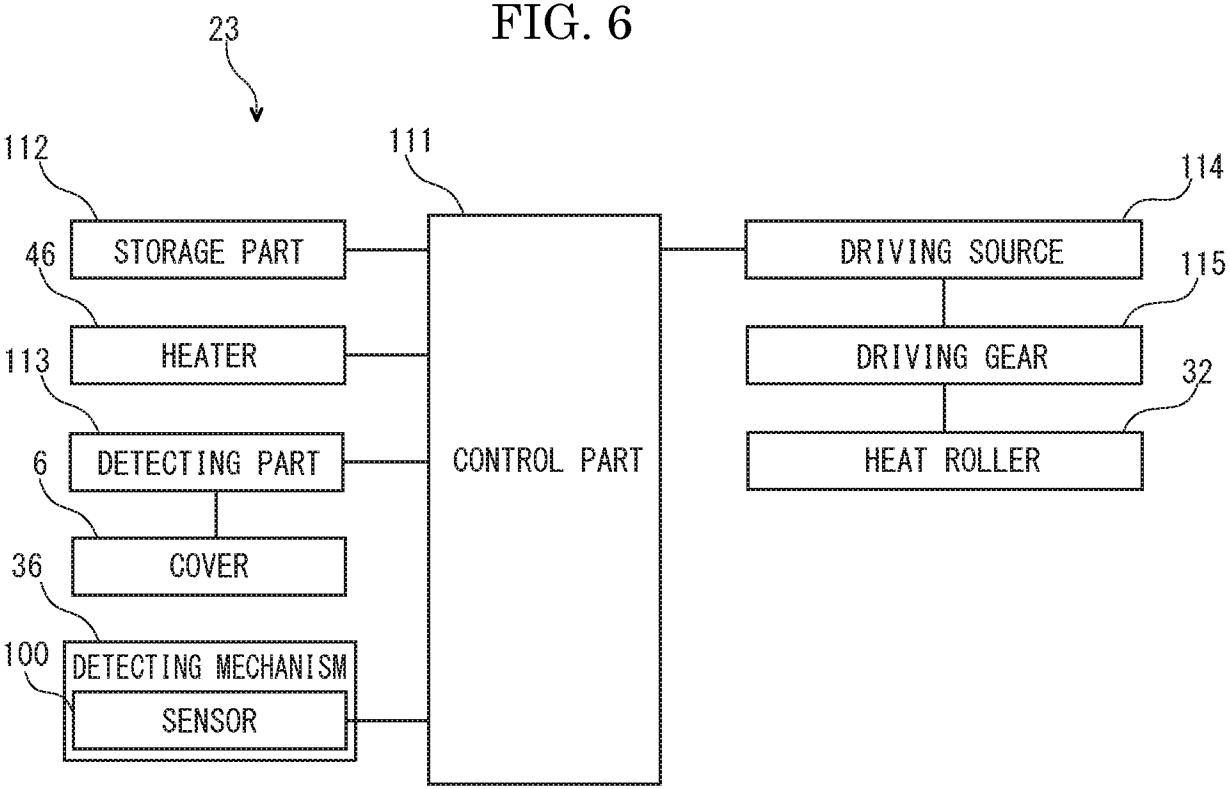
FIG. 6 is a block diagram showing a control system of the fixing device according to the embodiment of the present disclosure.

Next, a control system of the fixing device 23 will be described with reference to FIG. 6.

The fixing device 23 includes a control part 111. The control part 111 is connected to a storage part 112 composed of a storage device, such as a ROM or a RAM, and the control part 111 is configured to control each part of the fixing device 23 based on a control program or control data stored in the storage part 112.

The control part 111 is connected to each heater 46, and each heater 46 is powered on based on a signal from the control part 111 and each heater 46 heats the heat roller 32.

The control part 111 is connected to a detecting part 113. The detecting part 113 has a function of detecting opening or closing of the cover 6, and a detection result of the detecting part 113 is outputted to the control part 111.

The control part 111 is connected to the sensor 100 of the detecting mechanism 36, and a detection result of the sensor 100 is outputted to the control part 111.

The control part 111 is connected to a driving source 114 composed of a motor or the like. The driving source 114 is connected to the heat roller 32 via a driving gear 115.

An operation of fixing the toner image on the sheet in the fixing device 23 configured as described above will be described.

To fix the toner image on the sheet, the driving source 114 is rotated. When the driving source 114 is rotated in this way, a rotation of the driving source 114 is transmitted to the heat roller 32 via the driving gear 115, and the heat roller 32 is rotated (see an arrow B in FIG. 2). When the heat roller 32 is rotated in this way, the pressuring roller 33 coming into pressure contact with the heat roller 32 rotates in a direction opposite to a rotation direction of the heat roller 32 (see an arrow C in FIG. 2).

Further, to fix the toner image on the sheet, each heater 46 is powered on. When each heater 46 is powered on in this way, each heater 46 heats the heat roller 32. When the sheet passes through the fixing nip N in this state, the sheet and the toner image are heated and pressured, so that the toner image is fixed on the sheet.

Next, operation of detecting the sheet by using the detecting mechanism 36 of the fixing device 23 configured as described above will be described.

As shown in FIG. 4, in a state before the sheet passes through the fixing device 23, the actuator 101 is held at a non-blocking position by biasing force of the torsion coil spring 109, and the bent part 108 of the detected piece 106 does not block the light L directed from the light emitting part 102 of the sensor 100 toward the light receiving part 103. Hence, an output from the sensor 100 to the control part 111 is HIGH.

By contrast with this, while the sheet is passing through the fixing device 23, as shown in FIG. 5, the sheet (see a leader line S in FIG. 5) passing through the fixing nip N presses the pressed piece 105 of the actuator 101 to the upper side(the downstream side in the sheet conveying direction). According to this, the actuator 101 swings around the shaft 104 from the non-blocking position to the blocking position, and the bent part 108 of the detected piece 106 blocks the light L directed from the light emitting part 102 of the sensor 100 toward the light receiving part 103. Hence, the output from the sensor 100 to the control part 111 changes from HIGH to LOW.

Meanwhile, when the sheet has passed through the fixing device 23, as shown in FIG. 4, the biasing force of the torsion coil spring 109 swings the actuator 101 from the blocking position to the non-blocking position, and the bent part 108 of the detected piece 106 does not block the light L directed from the light emitting part 102 of the sensor 100 to the light receiving part 103. Hence, the output from the sensor 100 to the control part 111 switches from LOW to HIGH.

Thus, the actuator 101 swings between the blocking position and the non-blocking position every time the sheet passes through the fixing device 23. According to this, the detecting mechanism 36 detects sheets.

Next, an operation of performing JAM processing in the fixing device 23 configured as described above will be described.

To perform the JAM processing, the cover 6 is opened first as indicated by the two-dot chain line in FIG. 1. Next, the guide member 35 of the fixing device 23 is rotated from the closing position (see the solid line in FIG. 2) to the opening position (see the two-dot chain line in FIG. 2). Thus, the conveying path 20 formed in the fixing device main body 31 is exposed. In this state, the sheet is removed from the conveying path 20. When removal of this sheet is finished, the guide member 35 is rotated from the opening position to the closing position, and the cover 6 is finally closed. Thus, the JAM processing is finished.

Next, a track of the bent part 108 of the detected piece 106 of the actuator 101 in the fixing device 23 configured as described above will be described.

Figure 7:
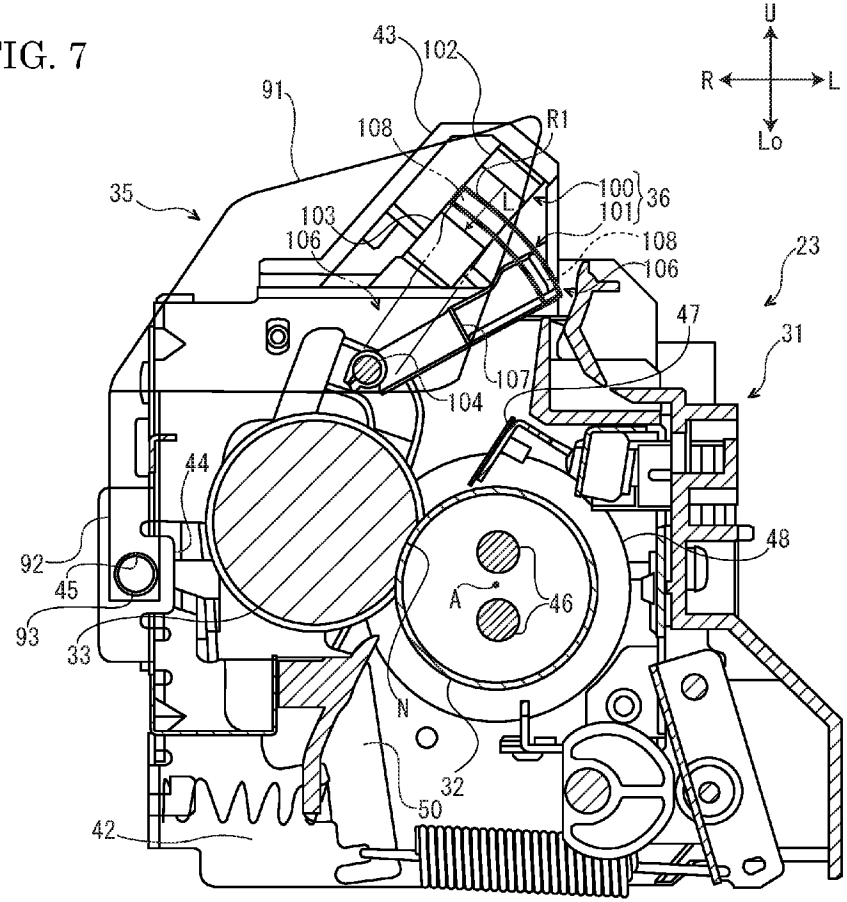
FIG. 7 is a sectional view showing a track of a bent part of a detected piece when the actuator swings with respect to a guide member, in the fixing device according to the embodiment of the present disclosure.

A region surrounded by a bold line R1 in FIG. 7 indicates the track of the bent part 108 of the detected piece 106 in case where the actuator 101 swings between the non-blocking position (see a solid line in FIG. 7) and the blocking position (see a two-dot chain line in FIG. 7) with respect to the guide member 35 (that is, in case where a sheet is detected) in a state where the guide member 35 is in the closing position. As shown in FIG. 7, the bent part 108 of the detected piece 106 is inserted between the light emitting part 102 and the light receiving part 103 of the sensor 100. Hence, there is no concern that an interference between the bent part 108 of the detected piece 106 and the light emitting part 102 or the light receiving part 103 of the sensor 100 blocks a swing of the actuator 101.

Figure 8:
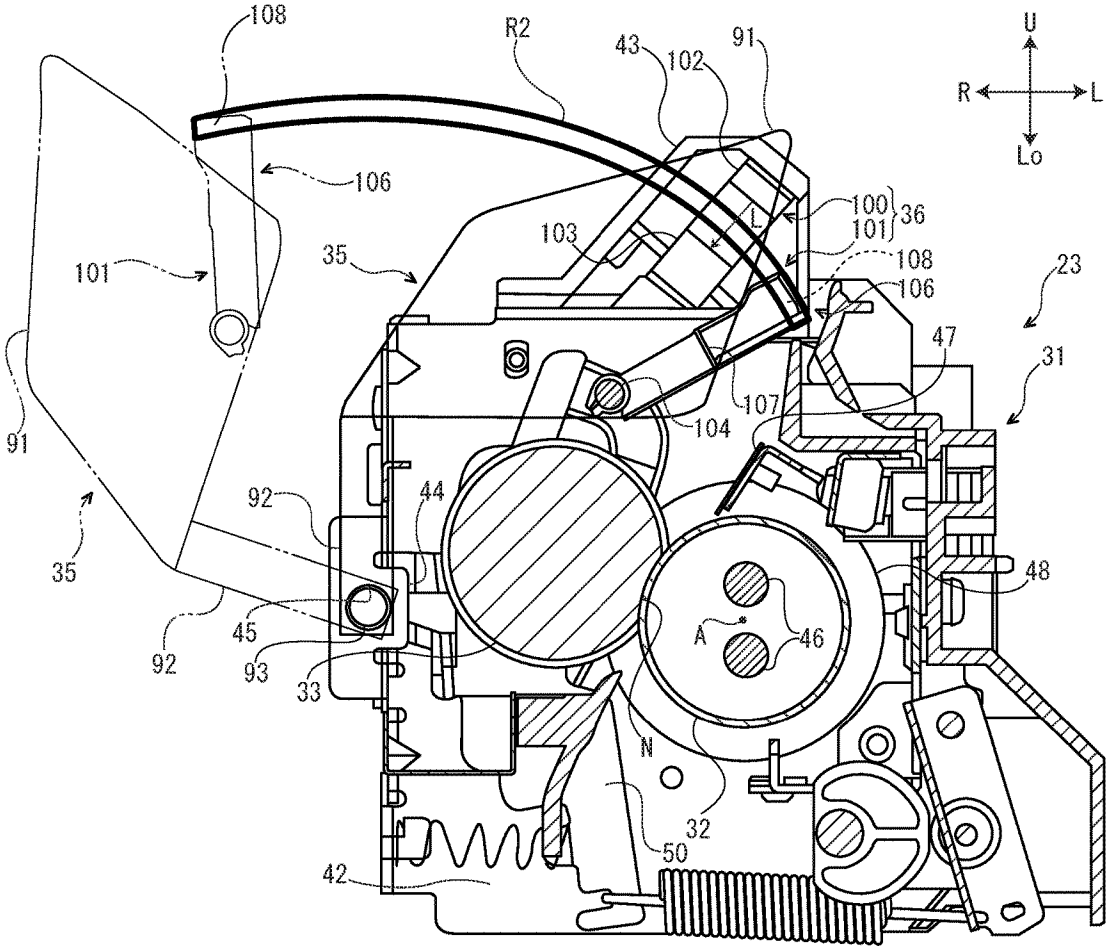
FIG. 8 is a sectional view showing a track of the bent part of the detected piece when the actuator rotates integrally with the guide member, in the fixing device according to the embodiment of the present disclosure.

A region surrounded by a bold line R2 in FIG. 8 indicates the track of the bent part 108 of the detected piece 106 in case where the actuator 101 rotates integrally with the guide member 35 (that is, in case where JAM processing is performed) with a rotation of the guide member 35 between the closing position (see a solid line in FIG. 8) and the opening position (see a two-dot chain line in FIG. 8). As shown in FIG. 8, the bent part 108 of the detected piece 106 passes between the light emitting part 102 and the light receiving part 103 of the sensor 100. Hence, there is no concern that the interference between the bent part 108 of the detected piece 106 and the light emitting part 102 or the light receiving part 103 of the sensor 100 blocks a rotation of the guide member 35.

As described above, according to the present embodiment, it is possible to prevent the rotation of the guide member 35 from being blocked by the interference between the bent part 108 of the detected piece 106 and the light emitting part 102 or the light receiving part 103 of the sensor 100 without using a link mechanism. Consequently, it is possible to prevent both of a rise in manufacturing cost of the fixing device 23 caused by introduction of the link mechanism and a sheet detection failure.

Further, each conveying rib 94 of the main body part 91 of the guide member 35 forms a part of the duplex conveying path 28 for performing the duplex printing to the sheet. By applying such a configuration, it is possible to reliably guide the sheet along the duplex conveying path 28.

Further, the sensor 100 is held by the front side plate 42 of the fixing device main body 31 via the attachment member 43. By applying such a configuration, it is possible to arrange the sensor 100 at the outside in the front and rear direction of the heat roller 32, and easily secure an installation space of the sensor 100 compared to a case where the sensor 100 is arranged such that the position of the sensor 100 in the front and rear direction overlaps that of the heat roller 32.

Further, when the sheet presses the pressed piece 105, the actuator 101 is configured to swing around the shaft 104 from the non-blocking position to the blocking position, so that the bent part 108 of the detected piece 106 blocks the light L directed from the light emitting part 102 toward the light receiving part 103. By applying such a configuration, it is possible to simplify the configuration of the actuator 101.

Further, as shown in FIG. 2, in a state where the guide member 35 is in the opening position (see a two-dot chain line in FIG. 2), the guide member 35 and the cover 6 interfere with each other so as to restrict closing of the cover 6. Meanwhile, when the guide member 35 rotates from the opening position (see the two-dot chain line in FIG. 2) to the closing position (see the solid line in FIG. 2), the guide member 35 moves to a position where the guide member 35 does not interfere with the cover 6, so that the cover 6 becomes closable. By applying such a configuration, if the detecting part 113 detects that the cover 6 is closed, the guide member 35 is naturally in the closing position. That is, the detecting part 113 which detects opening or closing of the cover 6 can check whether or not the guide member 35 is in the closing position.

In the present embodiment, when the sheet presses the pressed piece 105, the actuator 101 swings from the non-blocking position to the blocking position. In other embodiments, when the sheet presses the pressed piece 105, the actuator 101 may swing from the blocking position to the non-blocking position.

In the present embodiment, the rotation of the driving source 114 is transmitted to the heat roller 32, and the heat roller 32 and the pressuring roller 33 coming into pressure contact with the heat roller 32 are rotated. In other embodiments, the rotation of the driving source 114 may be transmitted to the pressuring roller 33, and the pressuring roller 33 and the heat roller 32 coming into pressure contact with the pressuring roller 33 may be rotated.

In the present embodiment, the heat roller 32 is used as the fixing member. In other embodiments, a fixing belt may be used as the fixing member.

In the present embodiment, a configuration of the present disclosure is applied to the color printer 1. In other embodiments, the configuration of the present disclosure may be applied to another image forming apparatus, such as a monochrome printer, a copying machine, a facsimile, an MFP (multi-function peripheral) or the like.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A fixing device comprising:

a fixing member configured to be rotatable around a rotation axis;

a pressuring member configured to be rotatable and to come into pressure contact with the fixing member so as to form a fixing nip;

a fixing device main body configured to rotatably support the fixing member by a side plate arranged on a side of the fixing device main body in a direction of the rotation axis;

a guide member supported by the fixing device main body so as to be rotatable between a closing position where the guide member covers a sheet conveying path formed in the fixing device main body and an opening position where the guide member exposes the sheet conveying path formed in the fixing device main body; and a detecting mechanism configured to detect a sheet, wherein the detecting mechanism includes:

a sensor including a light emitting part and a light receiving part, wherein the light emitting part and the light receiving part separated by a detecting gap; and an actuator supported by the guide member so as to be swingable between a non-blocking position where the actuator does not block a light directed from the light emitting part toward the light receiving part and a blocking position where the actuator blocks the light directed from the light emitting part toward the light receiving part, and a rotation center of the guide member is arranged at a different position from a swing center of the actuator, and when the actuator rotates integrally with the guide member according to a rotation of the guide member between the closing position and the opening position, the actuator passes between the light emitting part and the light receiving part;

an attachment member directly attached to a side face of the side plate, wherein the side face of the side plate facing an outside of the fixing device main body in the direction of the rotation axis;

the attachment member having a protruding part that protrudes above an upper edge of the side plate in a vertical direction, and the sensor is directly attached to a side face of the protruding part, wherein the side face of the protruding part facing the fixing member in the direction of the rotation axis, and the detecting gap facing the fixing member in the direction of the rotation axis, and the light receiving part is arranged at a lower side of the light emitting part.

2. The fixing device according to claim 1, wherein the guide member comprises a part of a duplex conveying path to perform a duplex printing on the sheet.

3. The fixing device according to claim 1, wherein the actuator includes:

a shaft attached to the guide member; and a pressed piece and a detected piece configured to protrude from the shaft to an outer diameter side, and when the sheet presses the pressed piece, the actuator swings around the shaft from the non-blocking position to the blocking position and the detected piece blocks the light directed from the light emitting part toward the light receiving part.

4. The fixing device according to claim 3, wherein a longitudinal first end part of the detected piece is fixed to the shaft, and a longitudinal second end part of the detected piece is provided with a bent part to block the light directed from the light emitting part toward the light receiving part.

5. The fixing device according to claim 4, wherein a longitudinal center part of the detected piece is provided with a step part.

6. The fixing device according to claim 3, further comprising a coil spring wound around the shaft, wherein the actuator is held at the non-blocking position by biasing force of the coil spring.

7. An image forming apparatus comprising the fixing device according to claim 1.

8. The image forming apparatus according to claim 7, further comprising a cover configured to be openable and closable and to cover an outer face of the fixing device, wherein closing of the cover is restricted in a state where the guide member is in the opening position, and the cover becomes closable after the guide member rotates from the opening position to the closing position.

* * * * *